US009732605B2

(12) United States Patent
Winslow

(10) Patent No.: US 9,732,605 B2
(45) Date of Patent: Aug. 15, 2017

(54) DOWNHOLE WELL TOOL AND COOLER THEREFOR

(75) Inventor: Daniel Winslow, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/958,459

(22) Filed: Dec. 2, 2010

(65) Prior Publication Data

US 2011/0146967 A1 Jun. 23, 2011

(51) Int. Cl.
*E21B 47/01* (2012.01)

(52) U.S. Cl.
CPC ..... *E21B 47/011* (2013.01)

(58) Field of Classification Search
CPC ..... E21B 36/00; E21B 36/005; E21B 43/24; E21B 47/011
USPC ..... 166/302, 57, 61, 65.1; 165/163; 62/399, 62/394, 260, 64, 259.2
See application file for complete search history.

(56) References Cited

U.S. PATENT DOCUMENTS

| | | | | |
|---|---|---|---|---|
| 2,283,118 | A * | 5/1942 | Arutunoff | 417/367 |
| 2,386,593 | A * | 10/1945 | Carter | 166/105 |
| 2,512,226 | A * | 6/1950 | Alton | 166/60 |
| 2,671,323 | A | 3/1954 | Richert | |
| 2,711,084 | A | 6/1955 | Bergan | |
| 2,794,504 | A * | 6/1957 | Carpenter | 166/61 |
| 3,038,074 | A | 6/1962 | Scherbatskoy | |
| 3,062,289 | A * | 11/1962 | Eades | 166/61 |
| 3,256,708 | A | 6/1966 | Redfern | |
| 3,435,629 | A | 4/1969 | Hallenburg | |
| 3,685,583 | A | 8/1972 | Phares | |
| 3,815,674 | A * | 6/1974 | Best et al. | 166/57 |
| 3,880,236 | A | 4/1975 | Durning et al. | |
| 4,126,406 | A * | 11/1978 | Traylor et al. | 417/373 |
| 4,248,298 | A * | 2/1981 | Lamers et al. | 166/57 |
| 4,287,957 | A | 9/1981 | Evans | |
| 4,375,157 | A * | 3/1983 | Boesen | 62/49.2 |
| 4,407,136 | A | 10/1983 | De Kanter | |

(Continued)

FOREIGN PATENT DOCUMENTS

| | | |
|---|---|---|
| DE | 3739689 A1 | 6/1989 |
| EP | 0579392 A1 | 1/1994 |

(Continued)

OTHER PUBLICATIONS

International Search Report with Written Opinion issued Jul. 28, 2010 for PCT Patent Application No. PCT/US09/069450, 12 pages.

(Continued)

*Primary Examiner* — Jennifer H Gay
(74) *Attorney, Agent, or Firm* — Chamberlain Hrdlicka

(57) ABSTRACT

A well tool can include a well tool housing and a cooling section positioned within the well tool housing, the cooling section including a helical cooling fluid flow path, and the flow path having a reversal of direction proximate an end of the cooling section. Another well tool can include a cooling fluid which flows through the helical flow path toward the end of the cooling section in one direction, and which flows through the helical flow path away from the end of the cooling section in an opposite direction. Another well tool can include the cooling fluid which flows through the helical flow path, and which makes multiple passes longitudinally through the cooling section proximate a heat-sensitive device.

18 Claims, 9 Drawing Sheets

(56) References Cited

U.S. PATENT DOCUMENTS

| | | | | |
|---|---|---|---|---|
| 4,533,526 | A * | 8/1985 | Delacour et al. | 423/1 |
| 4,741,386 | A | 5/1988 | Rappe | |
| 4,878,540 | A * | 11/1989 | Raymond | E21B 36/006 165/45 |
| 5,265,677 | A | 11/1993 | Schultz | |
| 5,442,131 | A | 8/1995 | Borgwarth | |
| 5,539,853 | A | 7/1996 | Jamaluddin et al. | |
| 5,623,986 | A * | 4/1997 | Wiggs | 165/45 |
| 5,701,751 | A | 12/1997 | Flores | |
| 5,720,342 | A | 2/1998 | Owens et al. | |
| 5,829,519 | A | 11/1998 | Uthe | |
| 5,862,866 | A | 1/1999 | Springer | |
| 5,931,000 | A | 8/1999 | Turner et al. | |
| 6,134,892 | A | 10/2000 | Turner et al. | |
| 6,336,408 | B1 | 1/2002 | Parrott et al. | |
| 6,341,498 | B1 | 1/2002 | DiFoggio | |
| 6,434,972 | B1 | 8/2002 | Geiger et al. | |
| 6,588,500 | B2 * | 7/2003 | Lewis | 166/61 |
| 6,672,093 | B2 | 1/2004 | DiFoggio | |
| 6,769,487 | B2 | 8/2004 | Hache | |
| 6,776,227 | B2 * | 8/2004 | Beida et al. | 166/61 |
| 6,955,221 | B2 * | 10/2005 | Bursaux | 166/303 |
| 6,978,828 | B1 * | 12/2005 | Gunawardana | 165/104.26 |
| 7,036,596 | B2 * | 5/2006 | Reid | 166/302 |
| 7,096,931 | B2 * | 8/2006 | Chang et al. | 165/133 |
| 7,665,524 | B2 * | 2/2010 | DeVault et al. | 166/302 |
| 2002/0100587 | A1 * | 8/2002 | Lewis | 166/303 |
| 2002/0104328 | A1 | 8/2002 | DiFoggio | |
| 2002/0148604 | A1 | 10/2002 | Emeric et al. | |
| 2004/0112601 | A1 * | 6/2004 | Hache | E21B 36/001 166/302 |
| 2004/0168794 | A1 * | 9/2004 | Vold | 166/65.1 |
| 2005/0061512 | A1 * | 3/2005 | Reid | 166/335 |
| 2005/0097911 | A1 | 5/2005 | Revellat et al. | |
| 2005/0146244 | A1 * | 7/2005 | Gunawardana | 310/315 |
| 2005/0269090 | A1 * | 12/2005 | Vinegar et al. | 166/302 |
| 2006/0081376 | A1 * | 4/2006 | Reid | 166/335 |
| 2007/0101734 | A1 | 5/2007 | Lucas | |
| 2008/0035345 | A1 * | 2/2008 | Kosakewich | 166/302 |
| 2009/0020265 | A1 * | 1/2009 | Feinauer et al. | 165/104.19 |
| 2010/0263869 | A1 * | 10/2010 | Kosakewich | 166/302 |
| 2011/0061934 | A1 * | 3/2011 | Jekielek | 175/40 |
| 2011/0146967 | A1 * | 6/2011 | Winslow | E21B 47/011 166/57 |
| 2012/0125610 | A1 * | 5/2012 | Prentice, III | E21B 43/2406 166/272.3 |

FOREIGN PATENT DOCUMENTS

| | | | | |
|---|---|---|---|---|
| GB | 2396203 | A * | 6/2004 | E21B 36/001 |
| WO | 0016118 | A1 | 3/2000 | |
| WO | 0045099 | A2 | 8/2000 | |

OTHER PUBLICATIONS

Aaron G. Flores; "Houston Product Center: Active Cooling for Electronics in a Wireline Oil-Exploration Tool", Engineering Report: Advanced Studies Engineering Report #7, dated May 30, 1996, 106 pages.

* cited by examiner

DOWNHOLE WELL TOOL AND COOLER THEREFOR

CROSS-REFERENCE TO RELATED APPLICATION

This application claims the benefit under 35 USC §119 of the filing date of International Application Serial No. PCT/US09/69450, filed Dec. 23, 2009. The entire disclosure of this prior application is incorporated herein by this reference.

BACKGROUND

The present disclosure relates generally to equipment utilized and operations performed in conjunction with a subterranean well and, in an embodiment described herein, more particularly provides a downhole well tool and a cooler for the well tool.

As well tools are used at increasing depths in wells, the temperatures which the well tools must withstand is also increasing. Even when not used at extreme depths, some well tools include heat-sensitive devices (such as, electronic circuits, sensors, emitters, etc.) which must be protected from heat generated by the devices themselves and/or from heat present in wellbore environments.

It will be appreciated that a need exists to effectively protect downhole well tools, and specifically the heat-sensitive devices thereof, from such heat.

DETAILED DESCRIPTION

Figure 1:
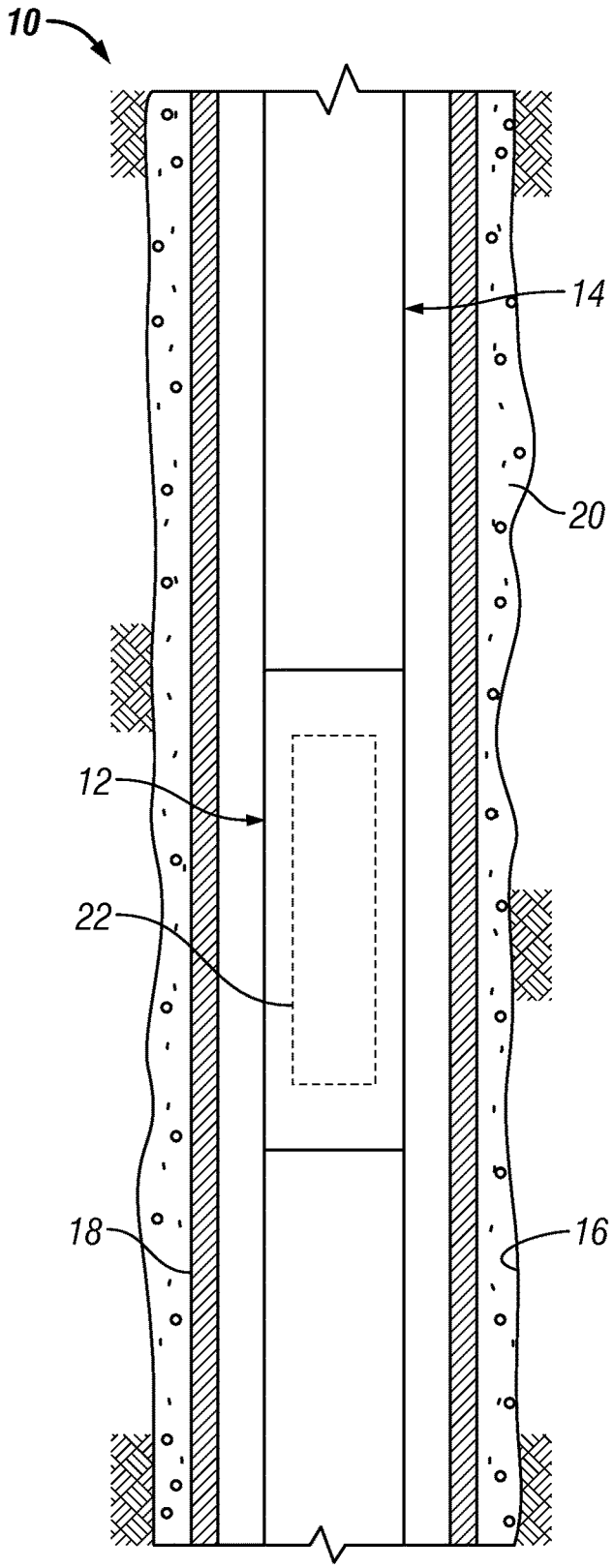
FIG. 1 is a schematic view of a well system embodying principles of the present disclosure.

Representatively illustrated in FIG. 1 is one example of a well system 10 which can embody principles of the present disclosure. In this example, a well tool 12 is interconnected in a tubular string 14 (such as, a production tubing, coiled tubing, work, test or drill string, etc.), and is conveyed into a wellbore 16 lined with casing 18 and cement 20.

However, it should be clearly understood that the various details of the well system 10 (such as, the tubular string 14, wellbore 16, casing 18 and/or cement 20) are not required to practice the principles described in this disclosure. For example, it is not necessary for a wellbore to be lined with casing or cement (e.g., a wellbore could be uncased or open hole), or for a well tool to be interconnected in a tubular string (e.g., a wireline or slickline could be used), in keeping with the principles of this disclosure.

The well tool 12 depicted in FIG. 1 includes a well tool cooler 22 which maintains a heat-sensitive device 24 (not visible in FIG. 1; see FIG. 3) of the well tool below a temperature which would otherwise damage the device. Damaging heat could originate from an earth formation surrounding the wellbore 16, from the device 24 itself, or from any other source.

Figure 2:
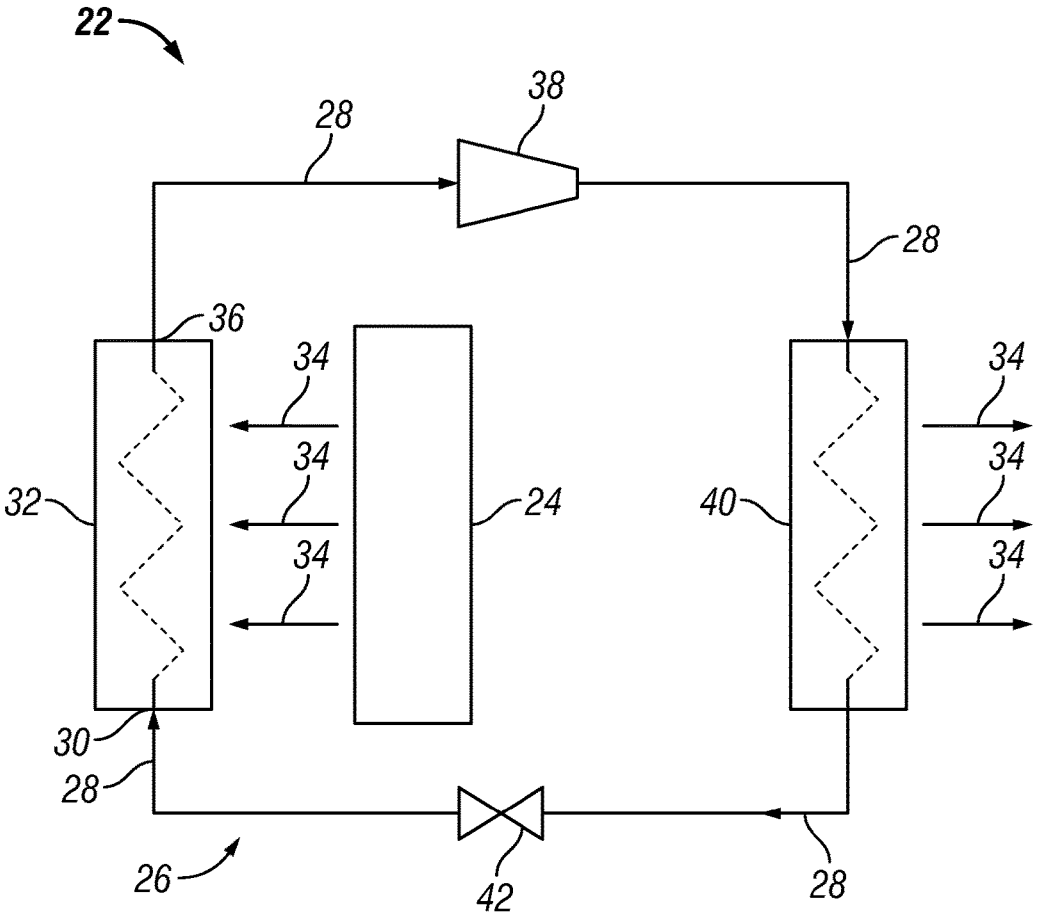
FIG. 2 is a schematic view of a refrigeration system which may be used for a well tool cooler in the system of FIG. 1.

Referring additionally now to FIG. 2, one example of a refrigeration system 26 which may be used in the well tool cooler 22 is representatively illustrated apart from the remainder of the well tool 12 and well system 10. The refrigeration system 26 is similar to a conventional four-stage refrigeration system.

Cooling (more accurately, removal of heat) is accomplished by continuously circulating, evaporating, and condensing a fixed supply of cooling fluid 28 in the closed refrigeration system 26. Evaporation occurs at a relatively low temperature and low pressure while condensation occurs at a relatively high temperature and high pressure. Thus, heat is transferred from an area of relatively low temperature (e.g., within the well tool 12) to an area of relatively high temperature (e.g., the surrounding wellbore 16 environment).

Beginning at an inlet 30 of a cooling section 32 of the well tool cooler 22, the cooling fluid 28 expands and absorbs heat 34 from the heat sensitive device 24 and/or the environment adjacent the device. The cooling fluid 28 evaporates, thereby changing phase to a relatively low-pressure gas by the time it reaches an outlet 36 of the cooling section 32.

A compressor 38 pumps the gaseous cooling fluid 28 from the cooling section 32 to a condenser 40. In the condenser 40, heat 34 is removed from the cooling fluid 28 (for example, by discharging the heat to the wellbore environment), and the cooling fluid condenses into a relatively high-pressure liquid.

Between the condenser 40 and the cooling section 32, the cooling fluid 28 passes through an expansion device 42 (such as, an expansion valve or orifice). The flow of the cooling fluid 28 into the cooling section 32 is controlled in this example by a pressure differential across the expansion device 42. In other examples, flow of the cooling fluid 28 could be temperature-controlled, etc.

Although not depicted in FIG. 2, the refrigeration system 26 could include other elements, such as an accumulator, a filter/dryer, an evaporator pressure regulator, evaporator discharge temperature controller, hot gas bypass regulator, electric solenoid valve, suction pressure regulator, condenser pressure regulator, low-side or high-side float refrigerant controller, oil separators, etc. These elements are well known to those skilled in the refrigeration art, and so they are not further described herein.

Note that the refrigeration system 26 depicted in FIG. 2 is merely one example of how the well tool cooler 22 could be configured to thermally protect the heat-sensitive device 24. In this example, the cooling fluid 28 may comprise a refrigerant, but in other examples the cooling fluid could comprise any type of fluid which is capable of absorbing heat 34 from the device 24 and/or its adjacent environment, and discharging that heat elsewhere (such as, to the wellbore 16 environment, etc.). Examples of suitable fluids which have been contemplated for use as the cooling fluid 28 include water, isopropyl alcohol, other alcohols, ammonia, propylene glycol, and mixtures of these fluids.

Figure 3:
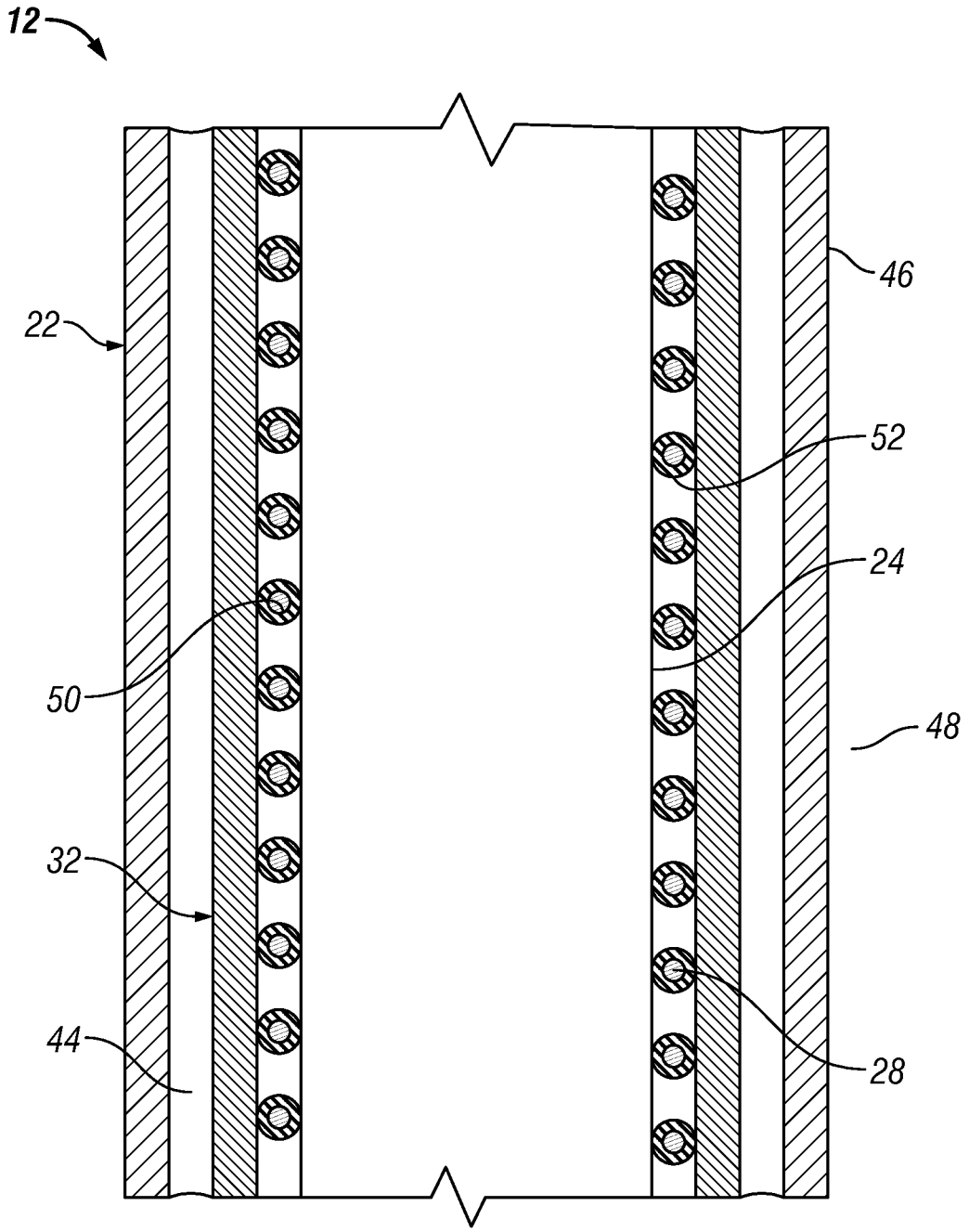
FIG. 3 is a schematic partially cross-sectional view of the well tool cooler which embodies principles of the present disclosure.

Referring additionally now to FIG. 3, a cross-sectional view of a portion of the well tool 12 is representatively illustrated. In this view, the well tool cooler 22 can be seen to include the cooling section 32 surrounding the heat-sensitive device 24. Of course, in other examples, the cooling section 32 could be within, longitudinally adjacent, or otherwise positioned relative to, the device 24.

An evacuated flask 44 is positioned radially between the cooling section 32 and an outer well tool housing 46. The flask 44 functions to insulate the cooling section 32 and device 24 from the high temperature wellbore 16 environment, which comprises an external heat source 48. In this manner, the cooling section 32 preferentially absorbs heat 34 from the device 24, rather than from the external heat source 48.

The flask 44 is preferably of the type known to those skilled in the art as a Dewar flask. Specifically, a Dewar flask typically comprises an insulated container having inner and outer walls with a vacuum between the walls and silvered surfaces facing the vacuum.

However, use of the flask 44 is not necessary, and other types of insulation, and other types of evacuated flasks, may be used in keeping with the principles of this disclosure. For example, thermal insulation (such as, a polyimide foam or other material having relatively low thermal conductivity) may be used instead of, or in addition to the flask 44. As another alternative, no insulation at all may be used between the external heat source 48 and the cooling section 32 or device 24.

The cooling section 32 in this example includes a helical flow path 50 for the cooling fluid 28. The cooling fluid 28 preferably flows through the helical flow path 50 from one end of the cooling section 32 to an opposite end of the cooling section, and then flows through the flow path in the opposite direction. In this manner, the cooling fluid 28 makes multiple passes longitudinally through the cooling section 32 adjacent the device 24, flowing helically through the flow path 50 in each pass, and absorbing heat 34 from the device 24 in each pass.

In the example depicted in FIG. 3, the flow path 50 extends through a helically formed tube 52, but other flow path configurations may be used in keeping with the principles of this disclosure.

Figure 4:
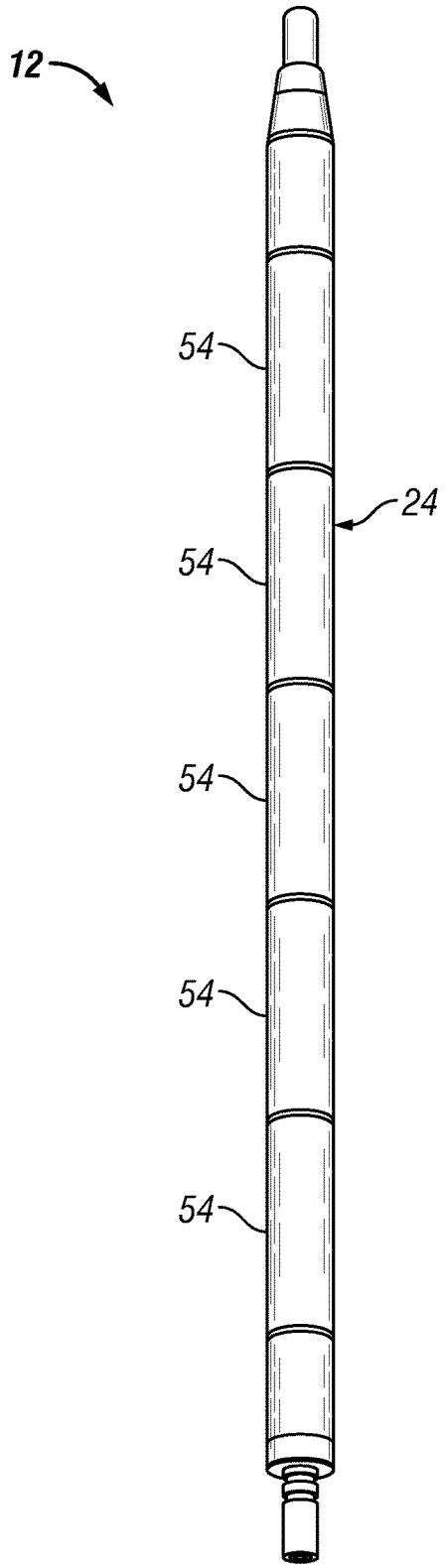
FIG. 4 is an elevational view of a heat-sensitive device which may be thermally protected by the well tool cooler.

Referring additionally now to FIG. 4, the heat-sensitive device 24 is representatively illustrated apart from the remainder of the well tool 12. In this example, the device 24 includes various components 54, some or all of which could be damaged by excessive heat when the well tool 12 is used in the wellbore 16 environment.

The components 54 could include electronic circuits, power supplies, etc. which generate heat when operated, sensors or other components (such as a scintillation detector or a piezoelectric-based pressure acceleration or force sensor, etc.) which could cease to function properly when overheated, or any other types of well tool components. Any type of device 24 and components 54 thereof can be thermally protected by the well tool cooler 22, whether or not the device or components themselves generate heat, in keeping with the principles of this disclosure.

Figure 5:
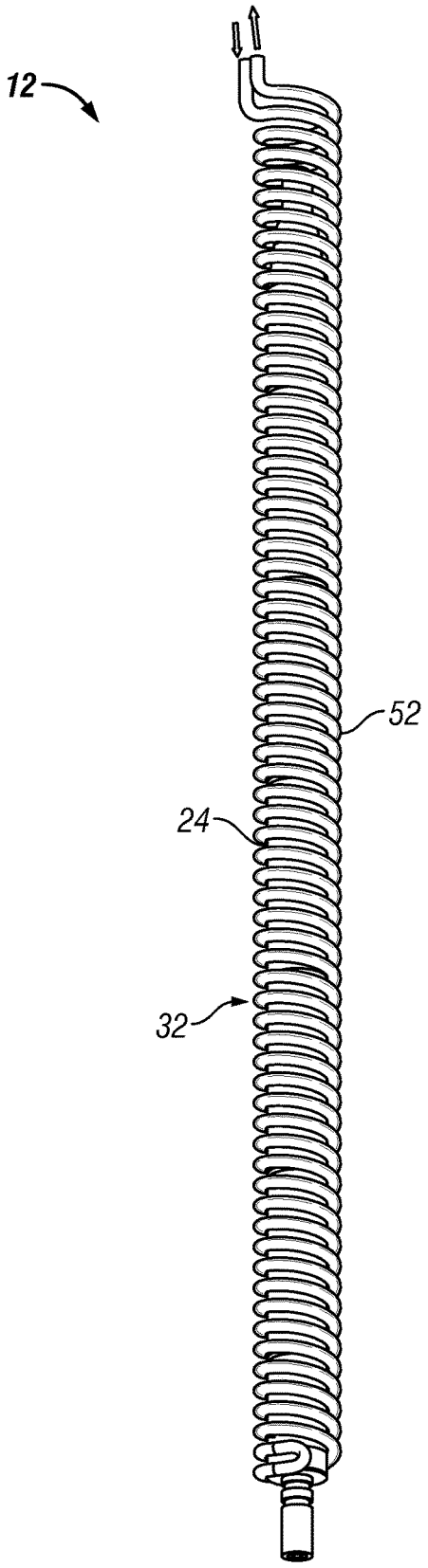
FIG. 5 is an elevational view of a cooling section of the well tool cooler positioned about the heat-sensitive device.

Referring additionally now to FIG. 5, the helical tube 52 of the cooling section 32 is depicted as being installed outwardly overlying the heat-sensitive device 24. The tube 52 is, thus, closely adjacent the device 24 to thereby more efficiently absorb heat 34 from the device.

Figure 6:
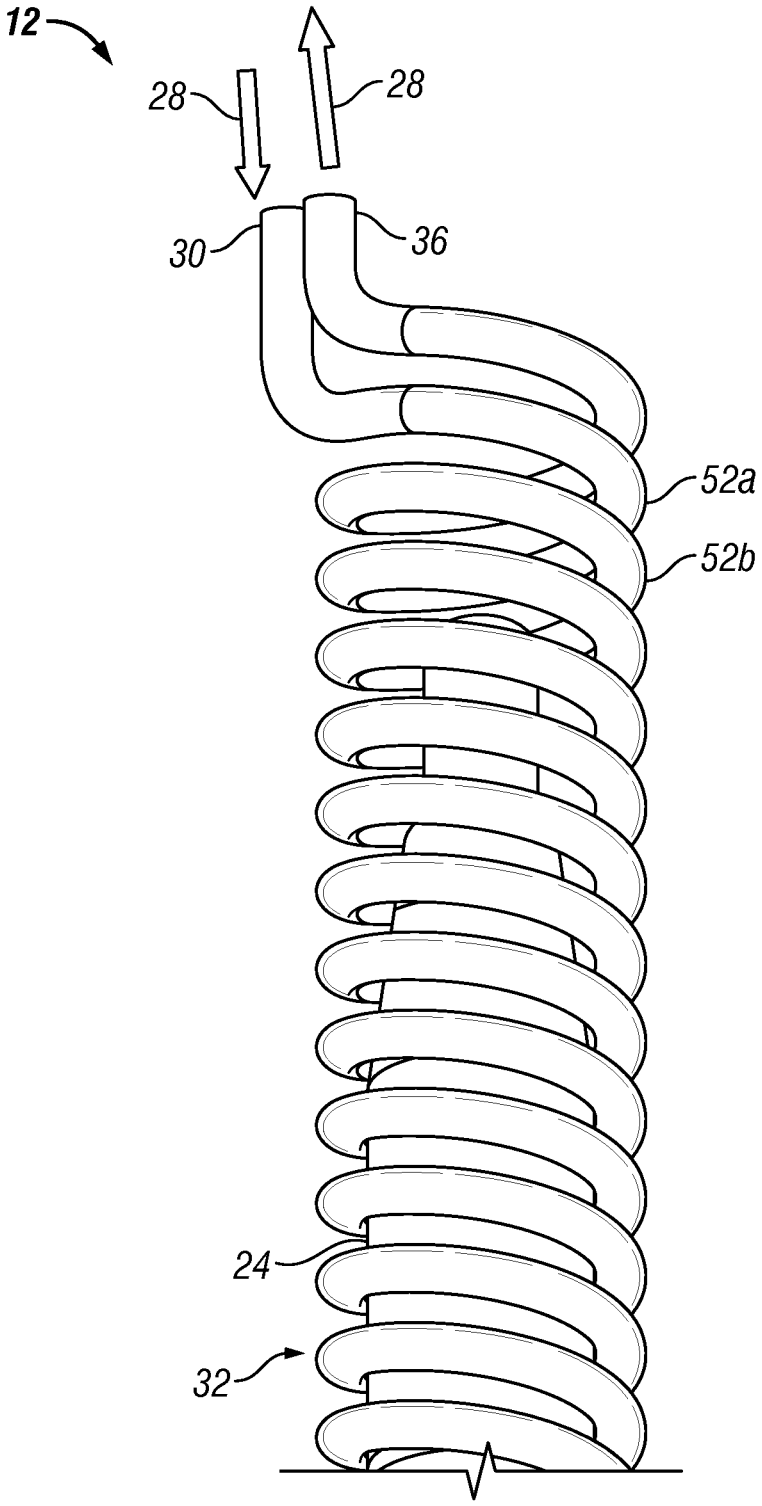
FIG. 6 is an enlarged scale elevational view of the ends of helical tube sections of the cooling section.

Referring additionally now to FIG. 6, an enlarged scale view of an upper end of the cooling section 32 is representatively illustrated. In this view it may be more clearly seen that the tube 52 includes a section 52*a* through which the cooling fluid 28 flows helically downward toward a lower end of the cooling section 32, and another section 52*b* through which the cooling fluid flows helically upward toward the upper end of the cooling section.

Figure 7:
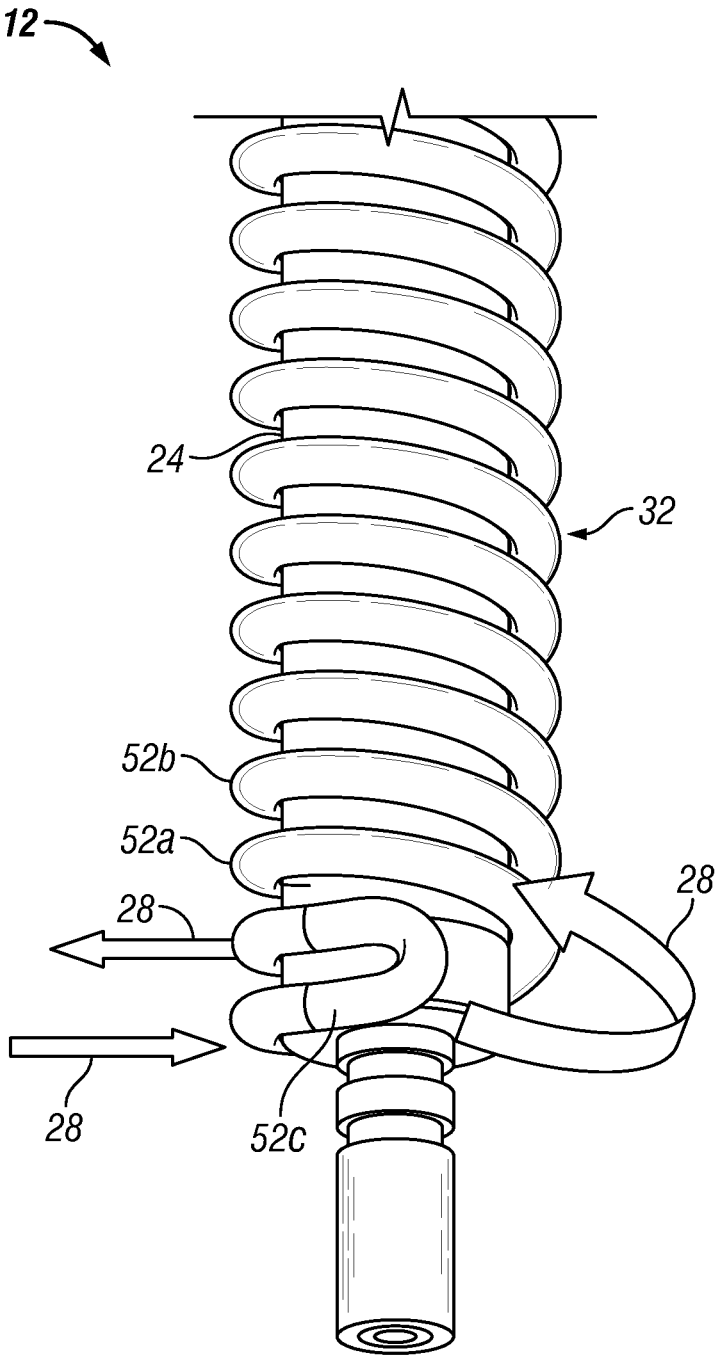
FIG. 7 is an elevational view of a U-tube section connecting ends of the helical tube sections.

Referring additionally now to FIG. 7, the lower end of the cooling section 32 is representatively illustrated. In this view, the manner in which a reversal of direction of flow of the fluid 28 in the cooling section 32 occurs can be more clearly seen.

Specifically, a U-turn section 52*c* is used to connect the tube sections 52*a*, 52*b*. Thus, the fluid 28 enters the U-turn section 52*c* from the helical tube section 52*a*, reverses direction in the U-turn section, and flows into the helical tube section 52*b*.

One benefit of this configuration of the cooling section 32 is that the inlet 30 and outlet 36 of the cooling section can both be positioned at one end of the cooling section for convenient connection to the compressor 38, condenser 40 and expansion device 42. Another benefit of this configuration is that the tube 52 and each of its sections 52*a-c*, and the flow path 50 and cooling fluid 28 therein, are maintained in close proximity to the heat-sensitive device 24 for maximum transfer of heat 34 from the device to the cooling fluid.

Figure 8:
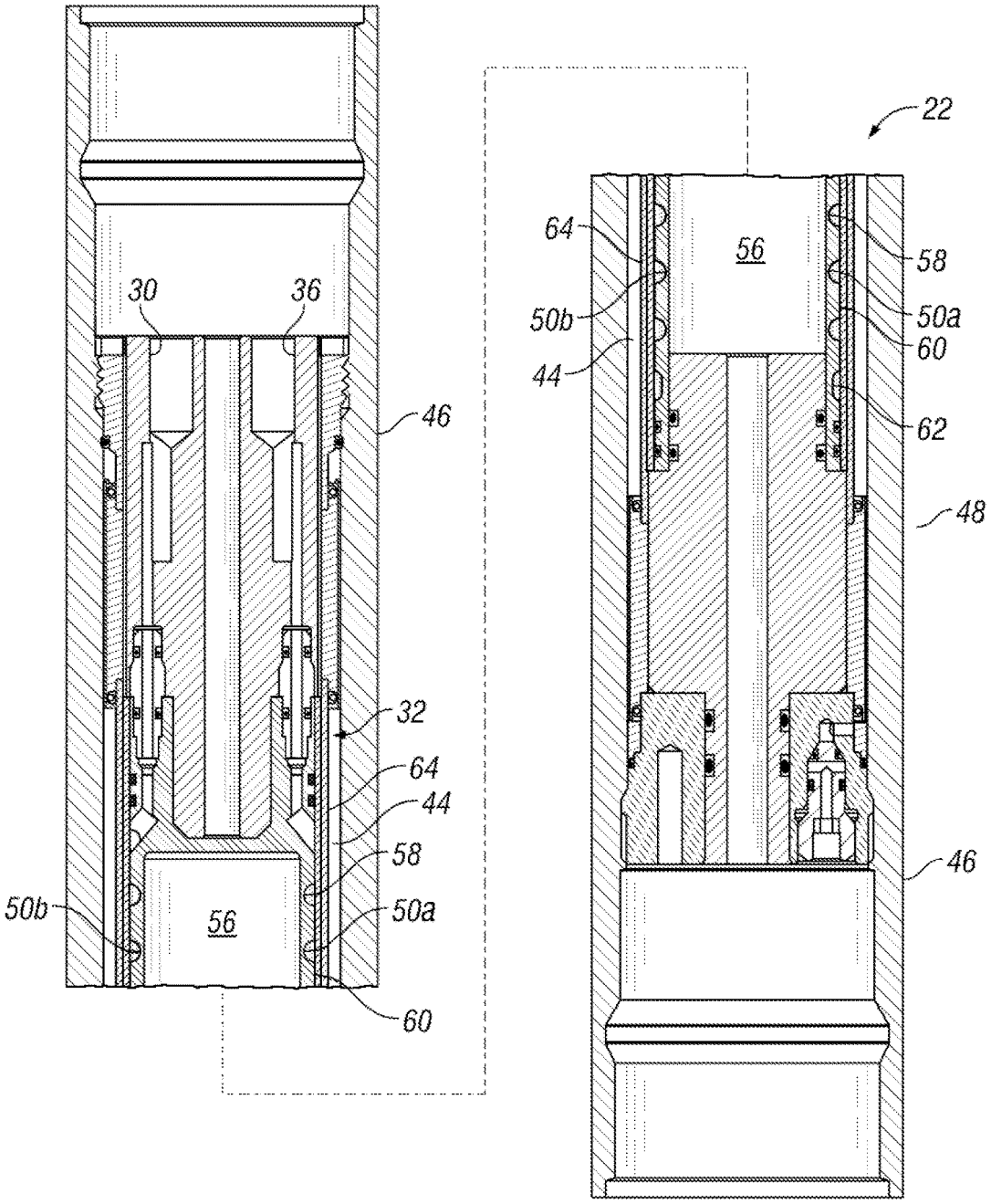
FIG. 8 is a schematic cross-sectional view of another configuration of the cooling section.

Referring additionally now to FIG. 8, another configuration of the cooling section 32 is representatively illustrated. The heat-sensitive device 24 is not depicted in FIG. 8 for illustrative clarity, but it would preferably be disposed in a cavity 56 within the cooling section 32 in actual practice.

One significant difference in the cooling section 32 depicted in FIG. 8 (as compared to the cooling section depicted in the previously described drawings) is that the flow path 50 comprises helical recesses 58 formed in a sleeve 60. The sleeve 60 radially outwardly surrounds the cavity 56 in which the heat-sensitive device 24 is positioned.

An annular recess 62 interconnects the helical recesses 58 (and, thus, the helical flow path sections 50*a*, 50*b*) at a lower end of the cooling section 32. Another sleeve 64 radially outwardly surrounds the sleeve 60 having the recesses 58 formed therein, thereby forming the closed helical flow path sections 50*a*, 50*b*.

Otherwise, the cooling section 32 of FIG. 8 functions in basically the same manner as the cooling section depicted in the previously described drawings. The cooling fluid 28 enters the inlet 30 and flows helically downward through the flow path section 50*a* toward the lower end of the cooling section 32, reverses direction in the annular recess 62, and flows helically upward through the flow path section 50*b* to the outlet 36. During each pass of the cooling fluid 28 longitudinally through the cooling section 32, the cooling fluid is closely proximate the cavity 56 containing the heat-sensitive device 24, thereby efficiently absorbing heat 34 from the device.

Figure 9:
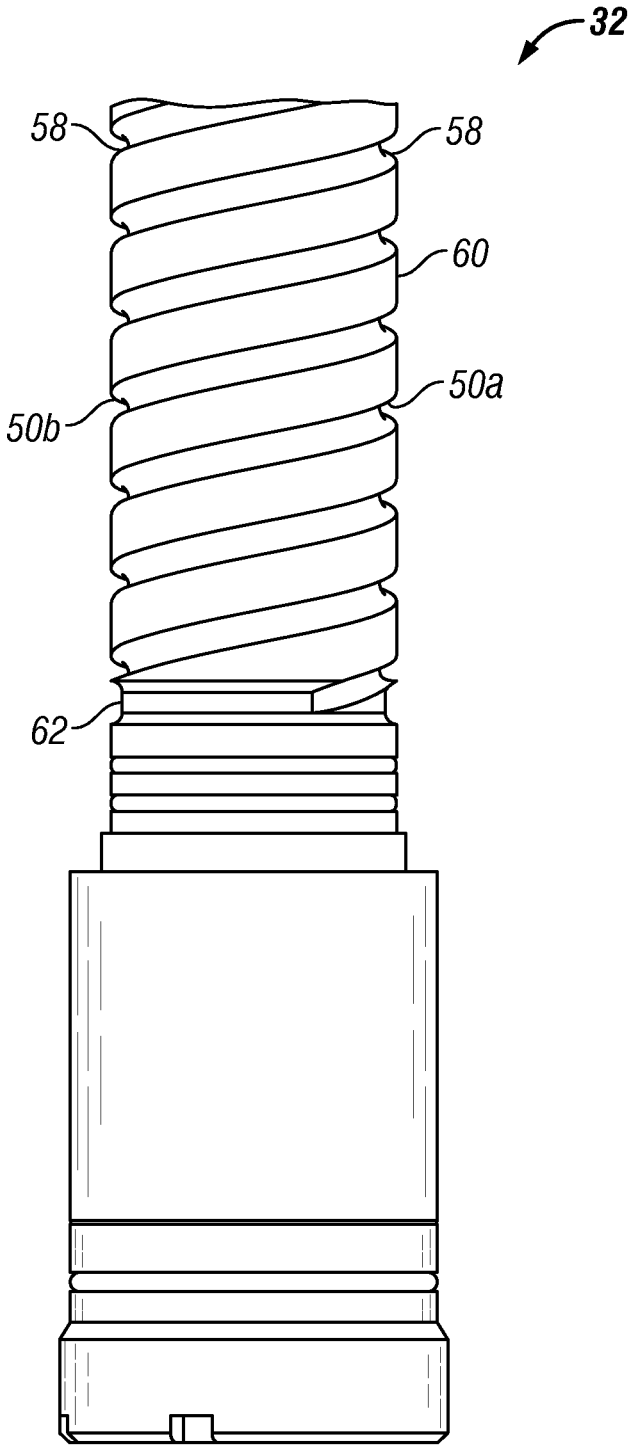
FIG. 9 is an enlarged scale elevational view of helical recesses in the cooling section of FIG. 8.

Referring additionally now to FIG. 9, the lower end of the cooling section 32 is representatively illustrated with the sleeve 64 removed from the sleeve 60, so that the helical recesses 58 are exposed. In this view, the manner in which the helical recesses 58 are in fluid communication with each other via the annular recess 62 is more clearly seen.

It may now be fully appreciated that the above disclosure provides several advancements to the art of providing thermal protection to downhole well tools. The well tool 12 described above is provided with the uniquely constructed cooling section 32 which efficiently and conveniently transfers heat 34 from the heat-sensitive device 24 to cooling fluid 28 which flows through the helical flow path 50.

In particular, the above disclosure describes the well tool 12 which can comprise a well tool housing 46 and a cooling section 32 positioned within the well tool housing 46. The cooling section 32 can include a helical cooling fluid flow path 50, with the flow path 50 having a reversal of direction proximate an end of the cooling section 32.

The flow path 50 may comprise multiple helical flow path sections 50*a*, 50*b* which are in fluid communication with each other proximate the end of the cooling section 32. The flow path 50 may extend through a U-turn section 52*c* which provides fluid communication between the helical flow path sections 50*a*, 50*b*.

The cooling section 32 may be positioned radially outward of a heat-sensitive device 24. A cooling fluid 28 may flow about the device 24 toward the end of the cooling section 32 in one direction, and the cooling fluid 28 may flow about the device 24 away from that end of the cooling section 32 in an opposite direction.

A first section 50*a* of the flow path 50 through which the cooling fluid 28 flows in the first direction is preferably positioned proximate the device 24, and a second section 50*b* of the flow path 50 through which the cooling fluid 28 flows in the second direction is also preferably positioned proximate the device 24.

The flow path 50 may be positioned radially between a heat source 48 and the heat-sensitive device 24, with the device 24 being thermally protected by the cooling section 32, and an evacuated flask 44 being positioned radially between the flow path 50 and the heat source 48.

The flow path 50 may extend through multiple helically formed tube sections 52*a*, 52*b*. The well tool 12 may further comprise a U-turn section 52*c* joining the tube sections 52*a*, 52*b*.

The flow path 50 may extend through multiple recesses 58 helically formed in a sleeve 60.

The cooling fluid 28 may make multiple passes longitudinally through the cooling section 32 proximate the heat-sensitive device 24.

Also described above is the well tool 12 which can include the well tool housing 46, the cooling section 32 positioned within the well tool housing 46, the cooling section 32 including the helical cooling fluid flow path 50, and the cooling fluid 28 which flows through the helical flow path 50 toward an end of the cooling section 32 in a first direction, and which flows through the helical flow path 50 away from the end of the cooling section 32 in a second direction opposite to the first direction.

The above disclosure also provides to the art the well tool 12 which can include the well tool housing 46, the cooling section 32 positioned within the well tool housing 46, the cooling section 32 including the helical cooling fluid flow path 50, and the cooling fluid 28 which flows through the helical flow path 50, and which makes multiple passes longitudinally through the cooling section 32 proximate the heat-sensitive device 24.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the above description of the representative embodiments, directional terms, such as "above", "below", "upper", "lower", etc., are used for convenience in referring to the accompanying drawings.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well tool for cooling a heat-sensitive device, comprising:

a well tool housing;

a well tool cooler comprising:

a cooling section within the well tool housing, the section comprising a first sleeve surrounded by a second sleeve and a helical flow path comprising helical recesses formed in the first sleeve to form closed helical flow path sections connected by an annular recess proximate an end of the cooling section such that cooling fluid flows through one helical recess, the annular recess, and then through another helical recess in a reverse direction to remove heat from the heat-sensitive device and evaporate the cooling fluid to form a gaseous cooling fluid; and a compressor positioned within the well tool housing and configured to receive and to pump the gaseous cooling fluid;

a condenser positioned within the well tool housing and configured to receive the gaseous cooling fluid from the compressor and condense the gaseous cooling fluid to a high-pressure liquid; and an expansion device positioned within the well tool housing and configured to receive the high-pressure liquid and lower the pressure of the high-pressure liquid.

2. The well tool of claim 1, wherein the flow path has a reversal of direction proximate the end of the cooling section.

3. The well tool of claim 1, wherein the cooling section is positioned radially outward of the heat-sensitive device, wherein the cooling fluid is flowable about the device toward the end of the cooling section in a first direction and away from the end of the cooling section in a second direction opposite to the first direction.

4. The well tool of claim 3, wherein a first section of the flow path through which the cooling fluid flows in the first direction is proximate the device, and wherein a second section of the flow path through which the cooling fluid flows in the second direction is proximate the device.

5. The well tool of claim 1, wherein the flow path is positioned radially between a heat source and the heat-sensitive device, the device being thermally protected by the cooling section, and an evacuated flask being positioned radially between the flow path and the heat source.

6. The well tool of claim 1, wherein the cooling fluid is flowable through multiple passes longitudinally through the cooling section proximate the heat-sensitive device.

7. A well tool for cooling a heat-sensitive device, comprising:

a well tool housing;

a well tool cooler comprising:

a cooling section within the well tool housing, the section comprising a first sleeve surrounded by a second sleeve and a helical flow path comprising helical recesses formed in the first sleeve to form closed helical flow path sections connected by an annular recess proximate an end of the cooling section;

a cooling fluid which is flowable through the helical cooling flow path toward an end of the cooling section in a first direction and away from the end of the cooling section in a second direction opposite to the first direction, wherein the flow of the cooling fluid removes heat from the heat-sensitive device, and wherein the cooling fluid is evaporable in the cooling section to form a gaseous cooling fluid; and a compressor positioned within the well tool housing and configured to receive and pump the gaseous cooling fluid;

a condenser positioned within the well tool housing and configured to receive the gaseous cooling fluid from the compressor and condense the gaseous cooling fluid to a high-pressure liquid; and an expansion device positioned within the well tool housing and configured to receive the high-pressure liquid and lower the pressure of the high-pressure liquid.

8. The well tool of claim 7, wherein the flow path has a reversal of direction proximate the end of the cooling section.

9. The well tool of claim 7, wherein the cooling fluid is flowable through multiple passes longitudinally through the cooling section proximate the heat-sensitive device.

10. The well tool of claim 7, wherein the cooling section is positioned radially outward of the heat-sensitive device, wherein the cooling fluid is flowable about the device toward the end of the cooling section in the first direction and away from the end of the cooling section in the second direction.

11. The well tool of claim 10, wherein a first section of the flow path through which the cooling fluid flows in the first direction is proximate the device, and wherein a second section of the flow path through which the cooling fluid flows in the second direction is proximate the device.

12. The well tool of claim 7, wherein the flow path is positioned radially between a heat source and the heat-sensitive device, the device being thermally protected by the cooling section, and an evacuated flask being positioned radially between the flow path and the heat source.

13. A well tool for cooling a heat-sensitive device, comprising:

a well tool housing;

a well tool cooler comprising:

a cooling section within the well tool housing, the section comprising a first sleeve surrounded by a second sleeve and a helical flow path comprising helical recesses formed in the first sleeve to form closed helical flow path sections connected by an annular recess proximate an end of the cooling section such that cooling fluid flows through multiple passes longitudinally through the cooling section proximate the heat-sensitive device, flowing through one helical recess, the annular recess, and then through another helical recess in a reverse direction to remove heat from and thermally protect the heat-sensitive device and evaporate the cooling fluid to form a gaseous cooling fluid; and a compressor positioned within the well tool housing and configured to receive and to pump a gaseous cooling fluid;

a condenser positioned within the well tool housing and configured to receive the gaseous cooling fluid from the compressor and to condense the gaseous cooling fluid to a high-pressure liquid; and an expansion device positioned within the well tool housing and configured to receive the high-pressure liquid and to lower the pressure of the high-pressure liquid.

14. The well tool of claim 13, wherein the cooling fluid is flowable towards an end of the cooling section in a first direction, and wherein the cooling fluid is flowable through the annular recess away from the end of the cooling section in a second direction opposite to the first direction.

15. The well tool of claim 13, wherein the flow path has a reversal of direction proximate an end of the cooling section.

16. The well tool of claim 13, wherein the cooling section is positioned radially outward of a heat-sensitive device, wherein the cooling fluid is flowable about the device toward an end of the cooling section in a first direction and away from the end of the cooling section in a second direction opposite to the first direction.

17. The well tool of claim 16, wherein a first section of the flow path through which the cooling fluid flows in the first direction is proximate the device, and wherein a second section of the flow path through which the cooling fluid flows in the second direction is proximate the device.

18. The well tool of claim 13, wherein the flow path is positioned radially between a heat source and the heat-sensitive device, the device being thermally protected by the cooling section, and an evacuated flask being positioned radially between the flow path and the heat source.

* * * * *